United States Patent [19]

Fillmore

[11] Patent Number: 4,830,228

[45] Date of Patent: May 16, 1989

[54] DISPENSER PACKAGE FOR VISCOUS FLUIDS

[75] Inventor: William E. Fillmore, Toledo, Ohio

[73] Assignee: Owens-Illinois Closure Inc., Toledo, Ohio

[21] Appl. No.: 182,013

[22] Filed: Apr. 15, 1988

[51] Int. Cl.[4] ..... B65D 37/00

[52] U.S. Cl. ..... 222/209; 222/260; 222/387

[58] Field of Search ..... 222/206, 207, 209, 212, 222/213, 380, 383, 385, 387, 256, 257, 259, 340, 341, 563; 417/437, 472; 92/98 R, 104

[56] References Cited

U.S. PATENT DOCUMENTS

| | | | |
|---|---|---|---|
| 2,774,518 | 12/1956 | Greene | 417/437 X |
| 3,141,580 | 7/1964 | Rogers | 222/213 |
| 3,294,288 | 12/1966 | Macare | 222/207 X |
| 3,506,163 | 4/1970 | Rauh et al. | 222/494 |
| 3,870,200 | 3/1975 | Spatz | 222/206 |
| 4,120,429 | 10/1978 | Vignot | 222/207 |
| 4,402,431 | 9/1983 | Wiegner et al. | 222/207 |

*Primary Examiner*—Andres Kashnikow
*Assistant Examiner*—Patrick N. Burkhart

[57] ABSTRACT

A dispenser package for viscous fluids comprising a container having one end open and provided with a piston and the other end closed by a compressible chamber defined by a plastic bellows that is deflected by movement of a plunger to dispense a portion of the viscous fluid from the container. The plastic bellows comprises a central tubular portion, a hub extending radially outwardly from the tubular portion, a plurality of circumferentially spaced panels extending transversely and radially from the tubular portion to a peripheral skirt extending axially away from the tubular portion. Integral circumferentially spaced ribs interconnect the panels. Alternate panels extend axially and radially upwardly away from the tubular portion while the remaining panels extend transversely and radially downwardly away from the tubular portion.

36 Claims, 5 Drawing Sheets

DISPENSER PACKAGE FOR VISCOUS FLUIDS

This invention relates to the dispensing of viscous fluids.

BACKGROUND AND SUMMARY OF THE INVENTION

In the dispensing of viscous fluids such as toothpaste and the like, it has heretofore been proposed that dispensing construction be provided that function upon compression of a collapsible chamber to dispense a portion of the viscous fluid. Typical dispensers are shown, for example, in U.S. Pat. Nos. 3,141,580, 3,506,163 and 4,402,431.

The dispenser container shown in U.S. Pat. No. 4,402,431 comprises a piston at one end of the container and a compressible chamber at the other which is actuated by axial displacement to dispense a portion of the contents.

It has also been suggested that the collapsible chamber be provided by a member that closes the container and includes a central tubular portion, circumferentially spaced planar portions extending from the tubular portion to a skirt, vertical ribs between the panels, and arcuate circumferentially spaced ribs on the panels at the juncture of the panels with the skirt.

One of the problems with respect to the collapsible chambers heretofore suggested is that it has been difficult to provide the desired amount of viscous fluid in the limited axial displacement of the chamber. Furthermore, the collapsible portion must be made of a highly elastomeric material which is costly.

Accordingly, among the objectives of the present invention are to provide a dispensing package which provides sufficient deflection in order to achieve the desired amount of dispensing; which is low in cost; and wherein the collapsible part may be formed integrally as a major component of the package.

In accordance with the invention, the dispenser package for viscous fluids comprises a container having one end open and provided with a piston and the other end closed by a compressible chamber defined by a plastic bellows that is deflected by movement of a plunger to dispense a portion of the viscous fluid from the container. The plastic bellows comprises a central tubular portion, a hub extending radially outwardly from the tubular portion, a plurality of circumferentially spaced panels extending transversely and radially from the hub to a peripheral skirt extending axially away from the tubular portion. Integral circumferentially spaced ribs interconnect the panels. Alternate panels extend axially and radially upwardly toward the tubular portion while the remaining panels extend transversely and radially downwardly away from the tubular portion.

DESCRIPTION

Figure 1:
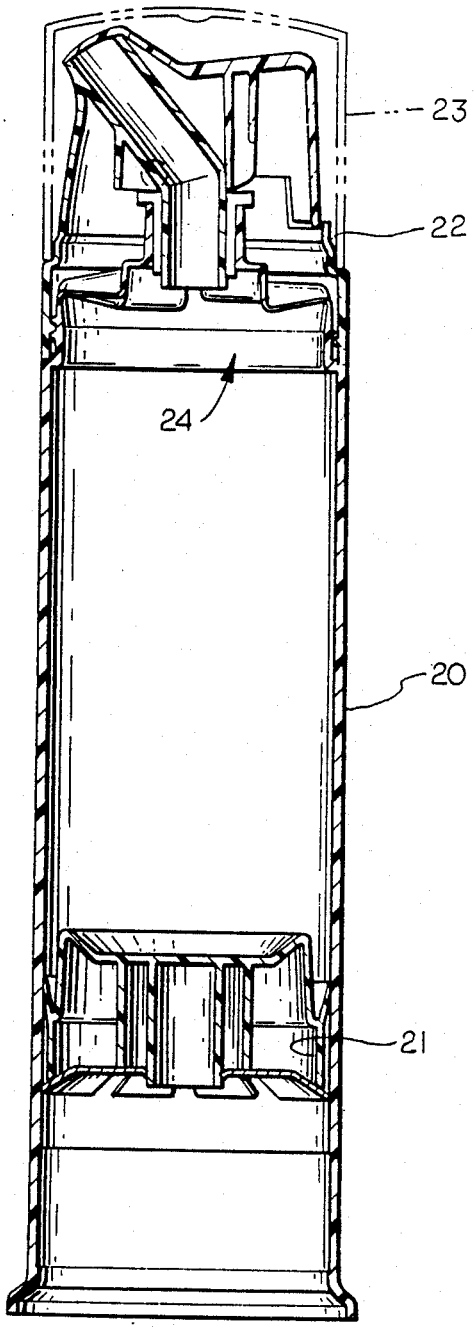
FIG. 1 is a vertical sectional view of a dispenser package embodying the invention.

Referring to FIG. 1, the dispenser package embodying the invention comprises a container 20 that has an open end in which a piston 21 is positioned and a dispenser head 22 attached to the upper end thereof over which a removable cap 23 is positioned.

Figure 2:
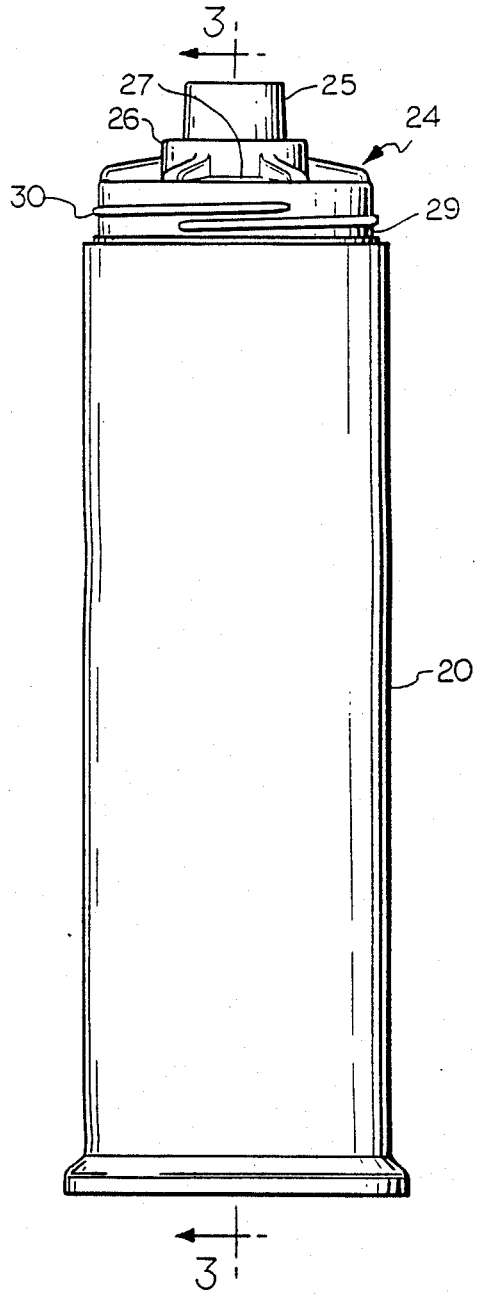
FIG. 2 is an elevational view of the container forming part of the package.
Figure 3:
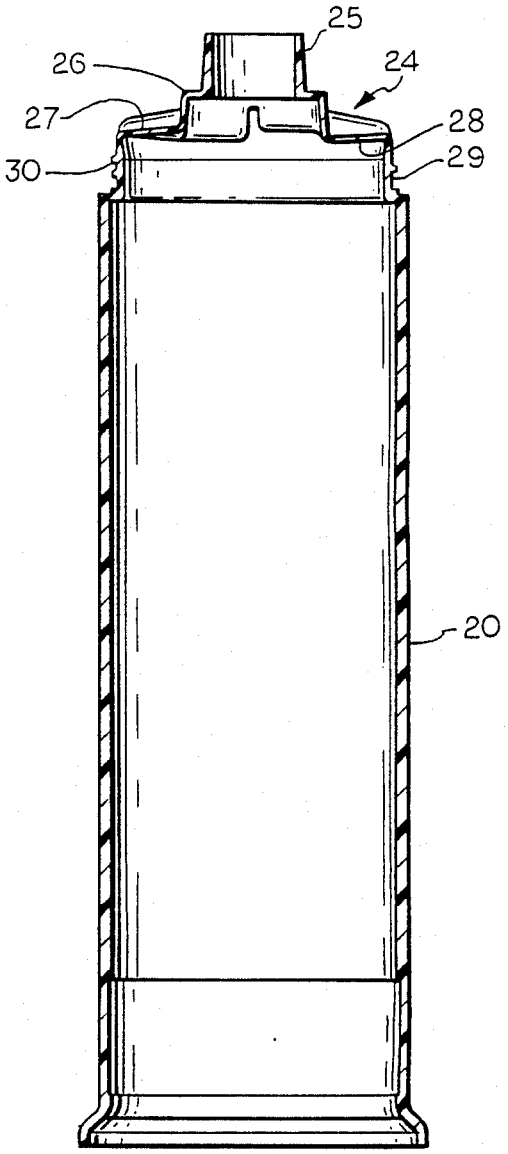
FIG. 3 is a vertical sectional view of the container.

As shown in FIGS. 2 and 3, the container 20 has an integral upper portion 24 that comprises a central tubular portion 25, a hub 26 spaced from the open end of the tubular portion 25 and having a larger diameter than the tubular portion, a plurality of panels 27, 28 extending generally radially outwardly and connected integrally to skirt 29 which, in turn, is integrally molded with the body of the container 20. The skirt 29 is provided with means, herein shown as an annular bead, threads 30 for receiving and retaining the skirt portion of the dispensing head 22 that is mounted in the tubular portion and movable axially, as presently described, to describe the collapsible portion or bellows 24.

Figure 4:
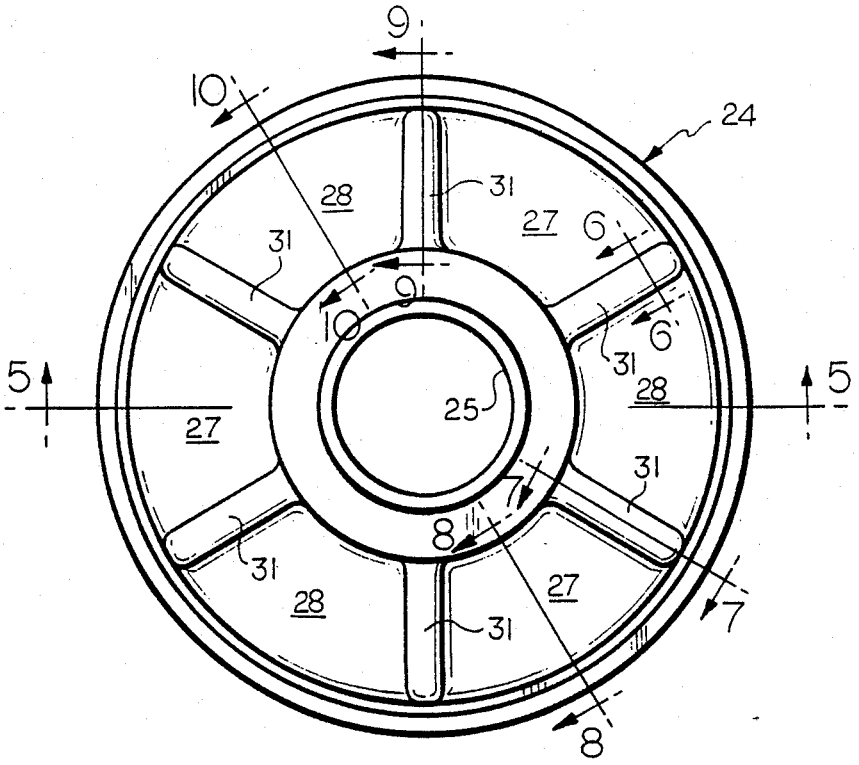
FIG. 4 is a plan view of the top portion of the container.
Figure 5:
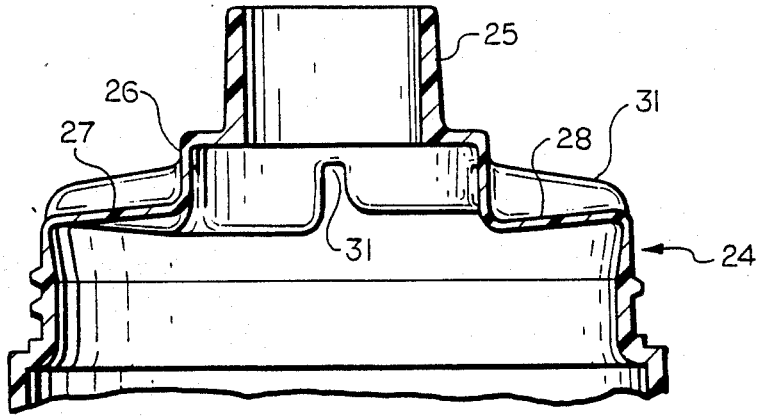
FIG. 5 is a sectional view taken along the line 5—5 in FIG. 4.
Figure 8:
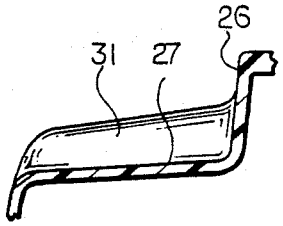
FIG. 8 is a sectional view taken along the line 8—8 in FIG. 4.
Figure 9:
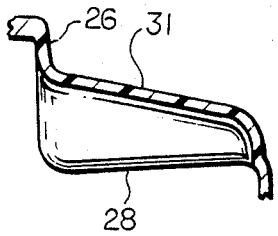
FIG. 9 is a sectional view taken along the line 9—9 in FIG. 4.
Figure 10:
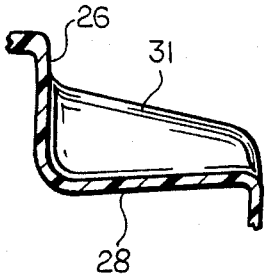
FIG. 10 is a sectional view taken along the line 10—10 in FIG. 4.
Figure 11:
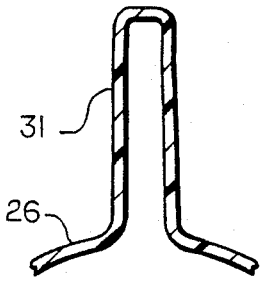
FIG. 11 is a sectional view taken along the line 11—11 in FIG. 6.

The second set of panels 28 extend outward and upward relative to the first set of panels 27. More specifically, the first set of panels may be horizontal or extend outward and downwardly from the tubular hub 26 and the second set of panels 28 always extend upward and outward from the tubular portion 25 and hub 26. Integral means 31 interconnect adjacent panels 27, 28 and preferably comprise circumferentially spaced ribs 31 that are hollow in cross section and have the closed portion thereof facing upwardly. The ribs 31 extend outwardly and radially from the tubular portion 26 (FIG. 4). Alternate panels 27 are preferably inclined downwardly and outwardly toward the skirt while alternate panels 28 are preferably declined upwardly and outwardly toward the skirt (FIG. 5).

Figure 6:
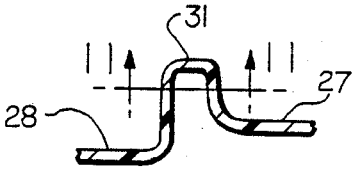
FIG. 6 is a sectional view taken along the line 6—6 in FIG. 4.
Figure 7:
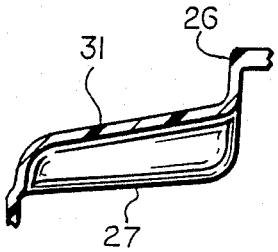
FIG. 7 is a sectional view taken along the line 7—7 in FIG. 4.
Figure 12:
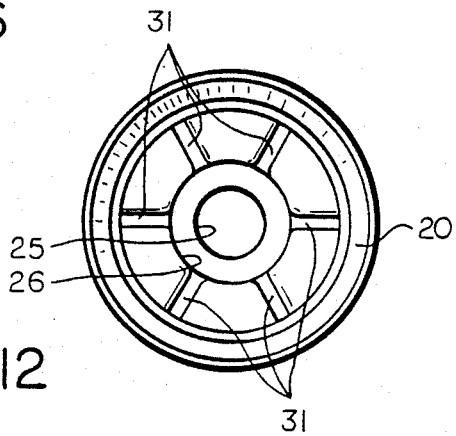
FIG. 12 is a bottom plan view of the container.

It can be seen that an even number of panels are provided, herein shown as comprising six panels separated by six hollow ribs. As shown, three of the panels 27 extend outward and downward at about 5° and the other three panels 28 extend inward and upward at about 5°. The hollow ribs 31 have sides of unequal height at the area of juncture with the panels and the central hub (FIG. 6). The central hub 26 also merges into the panels by curved portions. The angle between one set of panels and the other set of panels may vary and can be more or less than described.

Figure 13:
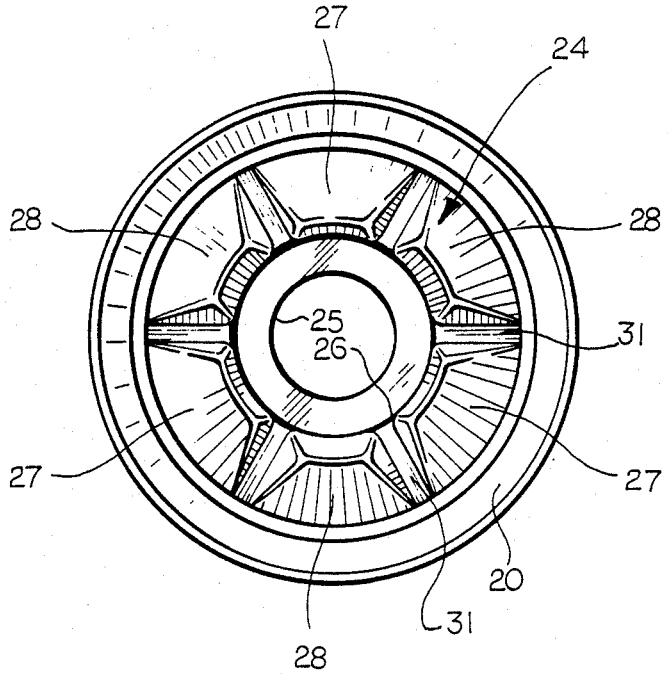
FIG. 13 is a bottom plan view of the container showing parts in a flexed position.

When the tubular portion 25 and, in turn, the hub 26 is depressed vertically, the panels and ribs are deflected downward. At maximum stroke, the deflection may be approximately 45°. Referring to FIG. 13, it can be seen that the integral ribs 31 permit the panels 27, 28 to move radially outwardly relative to the hub 26. This causes the lower panels 28 to exceed their resilient limit while the higher panels 27 retain resilience. When the depressing force is released, the upper resilient panels 27 function to raise the hub 26 and tube 25. As this action progresses, the lower panels 28 regain their resilience assisting in returning the hub 26 and tube 25 to normal position. As the hub 26 approaches the normal position, the upper panels 27 overtravel a level or horizontal position. The lower panels then exert the necessary force to bring all of the configurations into normal position.

The container and bellows are preferably made of a polyolefin plastic material and more preferably polypropylene.

The diameters of the skirt and hub can be increased or decreased to change the dispensing capacity in instances where the permissible maximum stroke remains fixed. For example, the diameter of the tubular portion 25 and the hub 26 can also be increased or decreased equally or separately or made of equal diameters to change the dispensing capacity of the bellows.

I claim:

1. A dispenser package for viscous fluids comprising a container having one end open and provided with a piston and the other end closed by a compressible chamber defined by a plastic bellows that is deflected by movement of a plunger to dispense a portion of the viscous fluid form the container, the plastic bellows comprising a central tubular portion and a peripheral skirt extending axially away from the tubular portion, said bellows comprises a plurality of integral circumferentially spaced panels extending transversely and radially from the tubular portion to said peripheral skirt, alternate panels extend axially and radially upwardly away from the tubular portion while the remaining panels extend transversely and radially other than upwardly away from the tubular portion.

2. The dispensing package set forth in claim 1 wherein said second mentioned alternate panels extend radially and downwardly.

3. The dispensing package set forth in claim 1 wherein said bellows includes integral means interconnecting said panels such as to permit radial outward movement of said panels relative to said tubular portion when said tubular portion is axially depressed.

4. The dispensing package set forth in claim 3 wherein said integral interconnecting means comprises radial ribs.

5. The dispensing package set forth in claim 4 wherein said ribs are hollow in cross section.

6. The dispensing package set forth in claim 5 wherein said ribs are substantially U-shaped in cross section.

7. The dispensing package set forth in claim 1 wherein said tubular portion is cylindrical.

8. The dispensing package set forth in claim 1 wherein said panels are substantially of equal size.

9. The dispensing package set forth in claim 1 wherein said skirt is formed with an integral thread.

10. For use in a dispenser package for viscous fluids comprising a container having one end open and provided with a piston and the other end closed by a compressible chamber defined by a plastic bellows that is deflected by movement of a plunger to dispense a portion of the viscous fluid from the container, a plastic bellows comprising a central tubular portion, said bellows comprising a plurality of circumferentially spaced panels extending transversely and radially from the tubular portion to a peripheral skirt extending radially away from the tubular portion, alternate panels extend axially and radially upwardly away from the tubular portion while the remaining panels extend transversely and radially other than upwardly away from the tubular portion.

11. The dispensing package set forth in claim 10 wherein said bellows includes integral means interconnecting said panels such as to permit radial outward movement of said panels relative to said tubular portion when said tubular portion is axially depressed.

12. The dispensing package set forth in claim 11 wherein said integral interconnecting means comprises radial ribs.

13. The dispensing package set forth in claim 12 wherein said ribs are hollow in cross section.

14. The bellows set forth in claim 13 wherein said ribs are substantially U-shaped in cross section.

15. The bellows set forth in claim 10 wherein said tubular portion is cylindrical.

16. The bellows set forth in claim 10 wherein said panels are substantially of equal size.

17. The bellows set forth in claim 10 wherein said bellows is formed a an integral part of the container.

18. A dispenser package for viscous fluids comprising a container having one end open and provided with a piston and the other end closed by a compressible chamber defined by a plastic bellows that is deflected by movement of a plunger to dispense a portion of the viscous fluid from the container, the plastic bellows comprising a central tubular portion, a hub extending radially outwardly from the tubular portion, a plurality of circumferentially spaced panels extending transversely and radially from the hub to a peripheral skirt extending axially away from the hub, integral circumferentially spaced ribs interconnect the panels, alternate panels extend axially and radially other than upwardly from the hub while the remaining panels extend transversely and radially upwardly away from the hub.

19. The dispensing package set forth in claim 18 wherein said first mentioned alternate panels extend radially and downwardly.

20. The dispensing package set forth in claim 19 wherein said bellows includes integral means interconnecting said panels such as to permit radial outward movement of said panels relative to said tubular portion when said tubular portion is axially depressed.

21. The dispensing package set forth in claim 20 wherein said integral interconnecting means comprises radial ribs.

22. The dispensing package set forth in claim 21 wherein said ribs are hollow in cross section.

23. The dispensing package set forth in claim 22 wherein said ribs are substantially U-shaped in cross section.

24. The dispensing package set forth in claim 18 wherein said tubular portion is cylindrical.

25. The dispensing package set forth in claim 18 wherein said panels are substantially of equal size.

26. The dispensing package set forth in claim 18 wherein said bellows is formed as an integral part of the container.

27. For use in a dispenser package for viscous fluids comprising a container having one end open and provided with a piston and the other end closed by a compressible chamber defined by a plastic bellows that is deflected by movement of a plunger to dispense a portion of the viscous fluid from the container, a plastic bellows comprising a central tubular portion, a hub extending radially outwardly from the tubular portion, a plurality of circumferentially spaced panels extending transversely and radially from the hub to a peripheral skirt extending axially away from the tubular portion, integral circumferentially spaced ribs interconnecting the panels, alternate panels extend axially and radially from the tubular portion other than upwardly while the remaining panels extend transversely and radially upwardly away from the tubular portion.

28. The dispensing package set forth in claim 27 wherein said first mentioned alternate panels extend radially and downwardly.

29. The dispensing package set forth in claim 27 wherein said bellows includes integral means interconnecting said panels such as to permit radial outward movement of said panels relative to said tubular portion when said tubular portion is axially depressed.

30. The dispensing package set forth in claim 29 wherein said integral interconnecting means comprises radial ribs.

31. The dispensing package set forth in claim 30 wherein said ribs are hollow in cross section.

32. The dispensing package set forth in claim 31 wherein said ribs are substantially U-shaped in cross section.

33. The bellows set forth in claim 31 wherein said ribs are substantially U-shaped in cross section.

34. The bellows set forth in claim 27 wherein said tubular portion is cylindrical.

35. The bellows set forth in claim 27 wherein said panels are substantially of equal size.

36. The bellows set forth in claim 27 wherein said bellows is formed as an integral part of a container.

* * * * *